United States Patent [19]

York

[11] 4,397,112

[45] Aug. 9, 1983

[54] RIFLE BIPOD

[76] Inventor: Norman N. York, 3703 Broadway, Houston, Tex. 77017

[21] Appl. No.: 246,406

[22] Filed: Mar. 23, 1981

[51] Int. Cl.[3] ..... F41C 29/00

[52] U.S. Cl. ..... 42/94; D22/13

[58] Field of Search ..... 42/94; 89/37 BA; 248/511, 530, 533, 538; D22/7, 13

[56] References Cited

U.S. PATENT DOCUMENTS 3,235,997 2/1966 Stoner ..... 42/94

3,235,998 2/1966 Hadley ..... 42/94

*Primary Examiner*—Stephen C. Bentley

*Attorney, Agent, or Firm*—Gunn, Lee & Jackson

[57] ABSTRACT

For use in supporting a rifle, the illustrated and preferred embodiment discloses a detachable bipod which is constructed with a pair of identical legs joined together at a pivot pin, the legs terminating in curved and polished faces, the two faces opposing one another to grasp and extend around the barrel of a weapon for holding the weapon, the bipod further including in the preferred and illustrated embodiment a coil spring between the two legs. The spring forces the legs apart. In addition, the two legs have facing hooks which latch against one another.

3 Claims, 6 Drawing Figures

FIG. 1
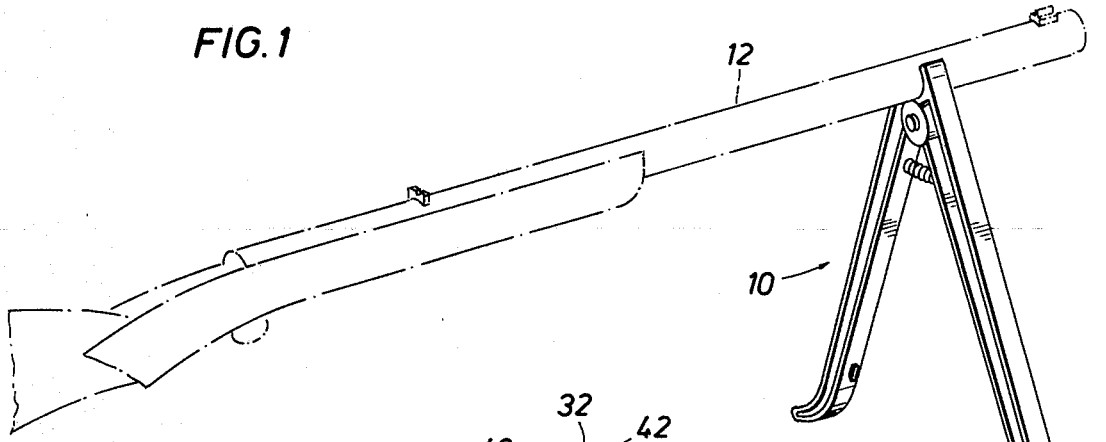
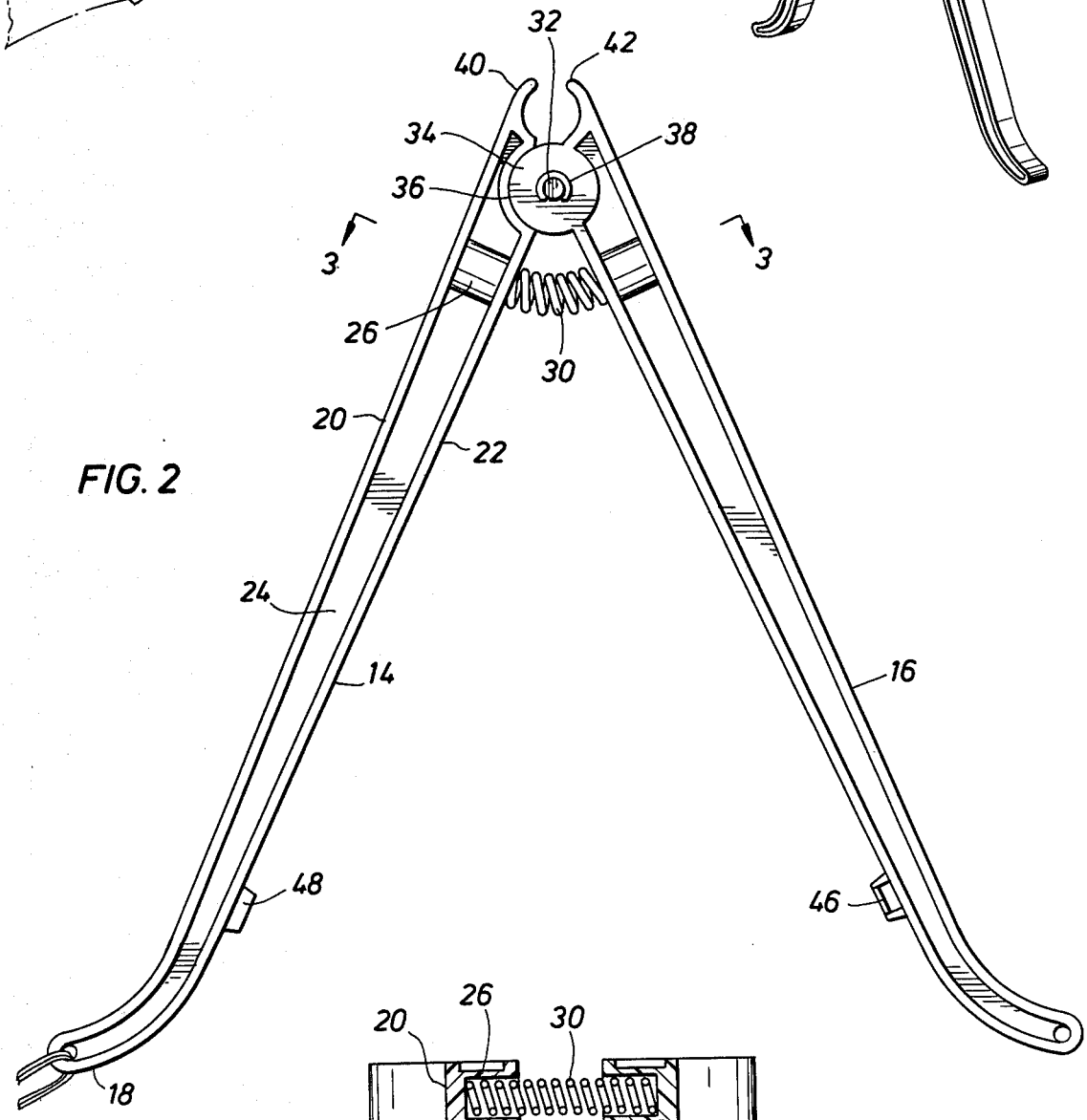
FIG. 2
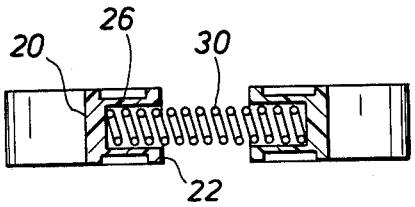
FIG. 3

FIG. 4
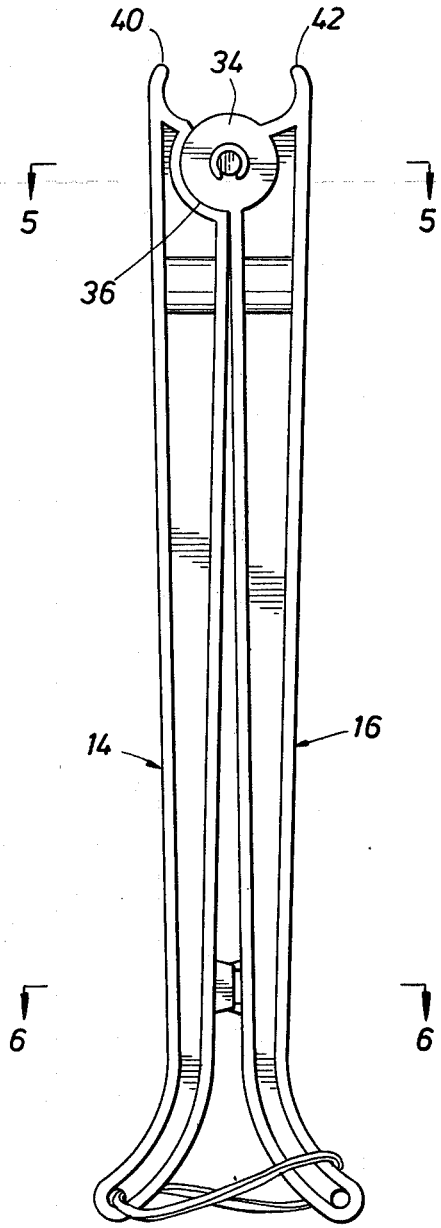
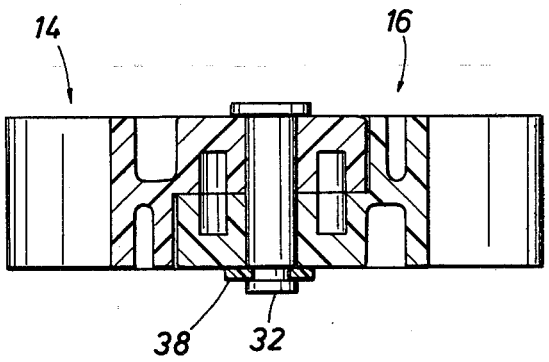
FIG. 5
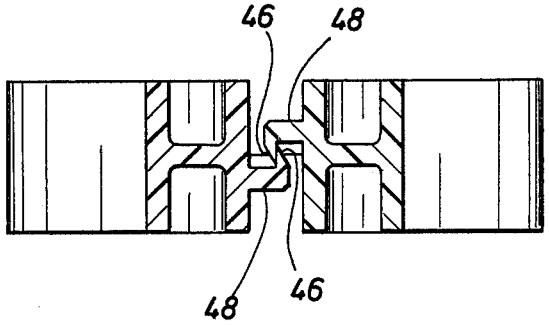
FIG. 6

RIFLE BIPOD

BACKGROUND OF THE DISCLOSURE

The present apparatus is directed to a bipod for supporting a rifle or other weapon equipped with a relatively long barrel. It is typically installed on a rifle. It can be used with a shotgun also although this is less plausible in light of the fact that shotguns have a spread pattern and stability at the time of firing is not as critical as it is with a rifle. The bipod of this disclosure is adapted to be placed on a rifle and easily and quickly removed from the rifle. It can be installed on a rifle and then removed quite easily. It is not a permanent installation. In fact, it has advantages over a permanently installed bipod in that the present bipod can be and is routinely fastened on a rifle after it has been removed from a storage cabinet, scabbard or the like. A rifle with a permanently attached bipod is awkward in shape and therefore difficult to store. The bipod of this disclosure enables the rifle to be stored in the conventional manner, as for instance, in a gun cabinet, in a gun case or scabbard and the like. Moreover, it is not permanently appended to the rifle and does not interfere with use of the rifle in any other posture. Also, of course, detachment of the bipod of this invention enables the rifle to be handled, shouldered or carried in any other conventional fashion.

The bipod of this disclosure is preferably formed of a plastic material, and particularly has a pair of legs which extend downwardly to lower ends, the legs being adapted to sit on surrounding terrain. The upper ends of the legs also are formed of plastic and terminate in arcuate gripping surfaces of plastic. The preferred use of plastic yields an apparatus which does not scratch, nick or otherwise damage the finish on the gun barrel. As will be appreciated, gun barrels are exposed to some wear and tear from damage to the finish. Most gun barrels are blued with a finish that protects them against rust. Moreover, the ideal material is a dark gray or black finish which is slightly rough, not smooth, sufficient to avoid reflective surfaces. In other words, the surface is made nonglare through the utilization of a dull gray to dark gray material which is finished with a slightly roughened surface. Glare is a detriment to the use of a weapon, and there is the chance that a glare from the bipod might detract from the use of the weapon.

With the foregoing in mind, the apparatus disclosed herein is summarized as a demountable rifle bipod. It is made with a pair of identical legs which are deployed about a pivot point. A spring installed between the legs forces them apart. As they are forced apart, the upper ends of both legs clamp on the barrel of the weapon and grasp around it sufficiently to hold the bipod to the weapon.

BRIEF DESCRIPTION OF THE DRAWINGS

So that the manner in which the above recited features, advantages and objects of the invention, as well as others, which will become apparent, are attained and can be understood in detail, a more particular description of the invention, briefly summarized above, may be had by reference to the embodiments thereof illustrated in the appended drawings, which drawings form a part of this specification. It is to be noted, however, that the appended drawings illustrate only typical embodiments of the invention and are not to be considered limiting of its scope, for the invention may admit to other equally effective embodiments.

FIG. 1 shows the bipod of the present disclosure installed on the barrel of a rifle to support the rifle;

FIG. 2 is an enlarged view showing the bipod of this disclosure in front view;

FIG. 3 is a sectional view along the line 3—3 showing details of construction of the spring which forces the legs apart for deployment of the bipod of the present invention.

FIG. 4 shows the legs folded together for storage and on releasing the bipod from the weapon;

FIG. 5 is a sectional view along the line 5—5 through the hinge; and

FIG. 6 is a sectional view along the line 6—6 through the latch.

DETAILED DESCRIPTION OF THE DRAWINGS

In the drawings, the bipod is identified by the numeral 10 and clamps on the barrel 12 of a rifle. It is ordinarily used with a rifle as opposed to a shotgun. It is particularly adapted to be used with weapons of moderate to long barrel lengths, and the weapon is presumed to be of conventional design and construction. The barrel will have a diameter in length appropriate for the particular size of weapon.

The present apparatus is symmetrically constructed with a pair of legs. In FIG. 2 the numeral 14 identifies a left leg and the numeral 16 identifies a right leg. Because they are identical in construction, a description of one will suffice for the other. They differ only in their relative deployment, namely with one extending to the right and the other extending to the left. Further, the bipod 10 utilizes a leg construction which has a foot 18 which is formed with a curvature at the lower end, the curvature defining a support surface. In cross section, the leg has the shape of an H with a central web. It is preferably formed of plastic material. The width is uniform or can slightly taper as shown in FIG. 2. There, it will be observed that it tapers in relative size until it reaches the foot where it curves outwardly. Moreover, the leg is perforated at the lower end to receive a lanyard or the like for easy storage of the bipod.

The leg 14 has an outer face 20 and an inner face 22, the two faces being almost parallel. They are approximately coextensive and taper towards one another at the lower end. The leg 14 further includes a central web of material at 24 which is included between plainer members comprising the faces 20 and 22. The central web 24 terminates at a cylindrical enlargement 26, the enlargement 26 being located between the faces 20 and 22. The enlargement 26 is cylindrical in cross section and interrupts the central web 24. It is cylindrical, hollow and open at the face 22. This defines a receptacle to receive a coil spring 30. The spring 30 is compressed when installed. It spans between the two legs to force them apart. One end is received in the receptacle 26. The other is received in the matching receptacle on the second leg.

The two legs are joined together by a pin 32 (See FIG. 5.) The pin 32 passes through an axial hole drilled in each leg. The leg is built with a circular enlargement 34 which surrounds the opening for the pin. The enlargement 34 matches a conforming or contoured face 36. It will be appreciated that each leg includes the enlargement 36. The enlargement 36, if extended fully, would define a circular knob or projection having the form of a right cylindrical disc. It is interrupted by the body of the leg. Moreover, the circular disc is immediately adjacent to the face 36. The notch or face 36 has a radius of curvature which enables it to seat against the mating or facing surface on the opposite leg. The two legs are identically constructed, and when arranged with one on the right and one on the left, they fit together by defining the curved mating surfaces 36 which receive the facing enlargements 34 so as to position the two legs for joinder. Moreover, the head of each leg is perforated at a suitable location so that the pin 32 can be anchored through them. The pin 32 is arranged at the center of the radius of curvature of the curved surface 36. The pin 32 is held in position by means of a snap ring 38 or braded rivet. The snap ring 38 seats in a groove in the pin 32. Identical grooves are provided, one at each end of the pin. Through the use of a snap rings 38 and pin head, the two ends of the pin clamp or fasten the two legs together.

As will be observed from the foregoing description, the upper end of each leg terminates in an exposed curved surface. This curved surface has the radius of curvature of some circle, and the upper tip end is rounded. When two legs are fitted together, they clamp and hold the rifle barrel. Actual clamping is accomplished by means of a curving and upwardly projecting tab 40. The tab is curved along the arc of a circle so that it will grasp the gun barrel. The tab 40 works opposite an identical tab. The two tabs provide a pinching or clamping movement. The two tabs clamp on the barrel. The two tabs are on the opposite side of the pivot so that the spring 30 forces them apart. The two tabs are particularly shaped to grasp the rifle barrel. As will be observed, there is a curved face. This curved face is a segment of a circle having a radius of curvature to enable it to fit around a barrel. In the event that the barrel has a slightly different diameter, no particular problem arises in that the barrel is still clamped between the facing members which are forced towards one another by operation of the spring 30. This motion clamps the bipod to the rifle. Clamping is achieved because the two legs are juxtapositioned on opposite sides of the rifle barrel. Should the barrel have a diameter which is slightly more or less than the diameter of the curvature of the projecting tabs, seating is still accomplished against the barrel and the barrel is held snuggly. As will be observed on FIG. 2 of the drawings, the two tabs in conjunction with the pivot pin enable the device to encircle about 270–300 degrees of the cylindrical barrel.

This method of clamping on the barrel is enhanced by rounding the corner at 42. No sharp edges are presented to the barrel. The rounded corner 42 prevents contact with sharp edges. Moreover, all of the surface is a plastic material having the hardness of cast polyethylene, nylon or other plastic type material. A typical material is polyethylene. It is not required that it be much harder. Moreover, it is manufactured with a relatively dark pigment in it. One pigment is carbon black. Carbon black is added in sufficient quantity to color the material to a relatively dark gray. The surface of the finished product is somewhat rough. It is textured by roughing the interior of the mold ever so slightly so that the surface has a roughness which appears to be unpolished. Moreover, the dark texture and the lack of polish creates a dull surface which will not cast a reflection. The surface finish on the inside of at the tab 40 can be uniform and more polished than the surface finish on the remainder of the equipment without marring or scratching the rifle barrel.

The foregoing describes the preferred embodiment of this apparatus. It is deployed by hand pressure. It is closed by forcing the legs together, and they are then permitted to spread as the spring 30 forces them apart. The spring 30 urges the two legs apart, thereby creating a clamping action which holds the bipod on the rifle.

As an enhancement, a locked tab is included. The locked tab is in the form of an upstanding L shaped member. It has a protruding lip 46 which is anchored on and reinforced by a base 48. The base 48 anchors to the leg. The L shaped tab 46 over hangs. The over hang enables the tab to engage itself when the two legs are brought together, thereby locking. The tab 46 extends outwardly from the plane of FIG. 2 by perhaps a fraction of an inch, perhaps one-eighth of an inch as shown in FIG. 6. A longer tab can be used but engagement and disengagement becomes more difficult as the length is increased.

The device of this disclosure is symmetrically constructed. This enables a single die to be made for manufacture of the leg and two identical legs can then be used. They fit together because they are constructed with symmetrical legs and they join in a symmetrical manner by hermaphroditic means. Each leg, being identical to the other, has a mating curving face whereby the two legs align so that the pin 32 can be placed through both of them.

While the foregoing is directed to the preferred embodiment, the scope is determined by the claims which follow.

I claim:

1. A removable and detachable bipod for attachment to the barrel of a rifle, comprising:

(a) first and second similar legs joined together at a pivot pin and forced apart below said said pivot pin by a coil spring positioned between said legs to force said legs apart whereby the lower ends of said legs are deployed in spaced relation to enable a bipod support for the rifle;

(b) said legs including upper ends having arcuately curved protruding tabs thereon which are adapted to releasably reach around and grasp the barrel of the rifle;

(c) receptacles in said legs adapted to receive the ends of said coil spring which is compressed when inserted into said receptacles, and wherein said coil spring is permitted to elongate to force said legs of the bipod apart; and (d) interlocking tabs on said legs which tabs lock said legs together.

2. The apparatus of claim 1, wherein said tabs are curved to extend arcuatelly partially about the barrel of the rifle and further wherein said tabs are formed of a nonreflective plastic material having curved faces in contact with the barrel to prevent scratching of the barrel and further wherein said plastic material is formed into said legs and finished with a surface preventing glare.

3. The apparatus of claims 2 or 1 wherein said legs join in hermaphroditic means.

* * * * *